US009300075B2

(12) United States Patent
Matsumura et al.

(10) Patent No.: US 9,300,075 B2
(45) Date of Patent: Mar. 29, 2016

(54) CONNECTOR WITH REINFORCED STRUCTURE

(75) Inventors: Kaoru Matsumura, Shizuoka (JP); Tomoyoshi Fukaya, Shizuoka (JP); Kenji Kajikawa, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 35 days.

(21) Appl. No.: 13/995,059

(22) PCT Filed: Dec. 19, 2011

(86) PCT No.: PCT/JP2011/079976

§ 371 (c)(1),
(2), (4) Date: Jun. 17, 2013

(87) PCT Pub. No.: WO2012/086833

PCT Pub. Date: Jun. 28, 2012

(65) Prior Publication Data

US 2013/0267123 A1 Oct. 10, 2013

(30) Foreign Application Priority Data

Dec. 21, 2010 (JP) ..... 2010-285092

(51) Int. Cl.
*H01R 13/40* (2006.01)
*H01R 13/46* (2006.01)
*H01R 13/422* (2006.01)

(52) U.S. Cl.
CPC ..... *H01R 13/46* (2013.01); *H01R 13/4223* (2013.01)

(58) Field of Classification Search
CPC ..... H01R 13/4223; H01R 13/4362
USPC ..... 439/595, 752
See application file for complete search history.

(56) References Cited

U.S. PATENT DOCUMENTS 4,664,460 A * 5/1987 Vandame ..... 439/595
5,009,615 A * 4/1991 Mobley et al. ..... 439/595

(Continued)

FOREIGN PATENT DOCUMENTS

CN 1359170 A 7/2002
EP 1 369 960 A1 12/2003

(Continued)

OTHER PUBLICATIONS

International Search Report and Written Opinion of the International Search Report for PCT/JP2011/079976 dated May 9, 2012.

(Continued)

*Primary Examiner* — Thanh Tam Le
(74) *Attorney, Agent, or Firm* — Kenealy Vaidya LLP

(57) ABSTRACT

A connector includes: a terminal including a box part which covers a terminal-contact spring, a crimped part which holds a core wire, and a concave part formed between the box part and the crimped part; and a housing integrally including an insertion port from which the terminal is inserted, an accommodation chamber in which the terminal is accommodated, an band which constitute a part of the accommodation chamber and is put into a double end-supported state so that the elastic band is pressed and elastically deformed by the box part of the terminal when the terminal is inserted in the housing from the insertion port, a lance which protrudes from an intermediate part of the band to engage the concave part of the terminal, and a reinforcement part which protrudes from the lance toward a bottom side of the housing to enter in the concave part of the terminal.

4 Claims, 4 Drawing Sheets

(56) References Cited

U.S. PATENT DOCUMENTS

| | | | | |
|---|---|---|---|---|
| 5,554,052 | A | 9/1996 | Saijo et al. | |
| 5,575,684 | A * | 11/1996 | Uchida et al. | 439/595 |
| 5,618,207 | A | 4/1997 | Maejima | |
| 5,820,411 | A * | 10/1998 | Okabe | 439/595 |
| 5,980,318 | A * | 11/1999 | Morello et al. | 439/595 |
| 6,676,448 | B2 * | 1/2004 | Kato | H01R 13/4223 439/595 |
| 6,767,259 | B2 * | 7/2004 | Kojima et al. | 439/752 |
| 6,769,934 | B2 | 8/2004 | Nakamura et al. | |
| 6,851,976 | B2 | 2/2005 | Ichida et al. | |
| 6,953,366 | B2 | 10/2005 | Fukatsu et al. | |
| 7,048,584 | B1 * | 5/2006 | Morello et al. | 439/595 |
| 7,059,903 | B2 * | 6/2006 | Sasaki et al. | 439/595 |
| 7,179,136 | B1 * | 2/2007 | Morello | 439/752 |
| 7,396,255 | B2 * | 7/2008 | Morello et al. | 439/595 |
| 7,601,035 | B2 | 10/2009 | Takahashi et al. | |
| 7,780,485 | B2 * | 8/2010 | Morello | 439/752 |
| 7,867,028 | B2 * | 1/2011 | Brown | H01R 13/4223 439/595 |
| 8,210,873 | B2 * | 7/2012 | Chikusa | 439/595 |
| 8,764,482 | B2 * | 7/2014 | Matsumura et al. | 439/595 |
| 8,784,133 | B2 * | 7/2014 | Suzuki | 439/595 |
| 2002/0064993 | A1 | 5/2002 | Kato et al. | |
| 2002/0102878 | A1 | 8/2002 | Murakami | |
| 2003/0027455 | A1 | 2/2003 | Yamawaki et al. | |
| 2003/0060075 | A1 | 3/2003 | Nakamura et al. | |
| 2003/0228793 | A1 | 12/2003 | Ichida et al. | |
| 2005/0090149 | A1 | 4/2005 | Fukatsu et al. | |
| 2006/0063427 | A1 | 3/2006 | Tanaka et al. | |
| 2009/0093168 | A1 | 4/2009 | Takahashi et al. | |

FOREIGN PATENT DOCUMENTS

| | | | |
|---|---|---|---|
| JP | 6-325814 | A | 11/1994 |
| JP | 7-34569 | U | 6/1995 |
| JP | 7-211381 | A | 8/1995 |
| JP | 2002-117928 | A | 4/2002 |
| JP | 2002-231362 | A | 8/2002 |
| JP | 2003-45544 | A | 2/2003 |
| JP | 2003-77575 | A | 3/2003 |
| JP | 2005-135636 | A | 5/2005 |
| JP | 2005-259363 | A | 9/2005 |

OTHER PUBLICATIONS

Japanese Office Action for the related Japanese Patent Application No. 2010-285092 dated Sep. 16, 2014.

Chinese Office Action and Search Report for the related Chinese Patent Application No. 201180060311.1 dated Jan. 7, 2015.

Chinese Office Action and Search Report for the related Chinese Patent Application No. 201180060311.1 dated Aug. 3, 2015.

Chinese Office Action and Search Report for the related Chinese Patent Application No. 201180060311.1 dated Feb. 2, 2016.

* cited by examiner

CONNECTOR WITH REINFORCED STRUCTURE

TECHNICAL FIELD

The present invention relates to a connector which is configured by accommodating a terminal into a housing.

BACKGROUND ART

There is a connector, for example, in which a terminal is engaged by a lance of a housing and doubly-engaging member attached to the housing (see Patent Literature 1, for example). The connector secures strength of terminal-engagement by doubly engaging the terminal. In the connector, the doubly-engaging member is movable between an actual engagement position and a provisional engagement position, and a blocking member is provided to regulate the erroneous movement and disengagement of the doubly-engaging member.

There is also a connector, for example, in which a lance is provided at one-side inner wall of an accommodation chamber of a housing, and an engagement projection is provided at the other-side inner wall of the accommodation chamber (see Patent Literature 2, for example). The connector secures strength of terminal-engagement by doubly-engaging the terminal with the lance and the engagement projection.

There is also a connector, for example, in which a lance is in a double end-supported state in which the lance is bent and deformed in a substantially arching line while the connection parts of both front and rear ends serve as fulcrum (see Patent Literature 3, for example). An engagement part of the lance of the connector is engaged with an engaged part formed at an intermediate position of a box part of the terminal.

CITATION LIST

Patent Literature

Patent Literature 1: JP-6-325814A

Patent Literature 2: JP-7-211381A (corresponding U.S. Pat. No. 5,618,207A)

Patent Literature 3: JP-2003-77575A (corresponding US 2003/0060075A1)

SUMMARY OF INVENTION

Technical Problem

The connector disclosed in Patent Literature 1 includes the doubly-engaging member and the blocking member for regulating the erroneous movement and disengagement of the doubly-engaging member. Therefore, the number of components increases and the labor time of assembling increases. Further, since the doubly-engaging member is held by the housing and the blocking member, an assembling play occurs between the housing and the blocking member. The assembling play serves as a play when the doubly-engaging member engages the terminal and reduces the effective contact part of the terminal. As a result, there is a possibility that the connection reliability is deteriorated.

In the connector disclosed in Patent Literature 2, since the terminal is doubly engaged by the lance provided at the one-side inner wall of the housing and the engagement projection provided at the other-side inner wall of the housing, it becomes difficult to downsize the connector in its vertical direction of the height between the one-side inner wall and the other-side inner wall of the housing.

In the connector disclosed in Patent Literature 3, since the terminal is engaged only by the engagement part of the lance, the strength of terminal-engagement of the engagement part cannot be secured sufficiently.

The present invention has been made in view of the above circumstances, and an object of the present invention is to provide a connector capable of preventing increase in assembling labor time and deterioration of the connection reliability and capable of downsizing in the height direction and enhancing the strength of terminal-engagement.

Solution to Problem

A connector according to an aspect of the invention is configured as any one of the following (1) to (4).

(1) A connector, including: a terminal including a box part which covers a terminal-contact spring, a crimped part which holds a core wire, and a concave part which is formed between the box part and the crimped part; and a housing integrally including an insertion port from which the terminal is inserted, an accommodation chamber in which the terminal is accommodated, an band which constitute a part of the accommodation chamber and is put into a double end-supported state so that the elastic band is pressed and elastically deformed by the box part of the terminal when the terminal is inserted in the housing from the insertion port, a lance which protrudes from an intermediate part of the band to lock the concave part of the terminal, and a reinforcement part which protrudes from the lance toward a bottom side of the housing to enter in the concave part of the terminal.

(2) The connector according to (1), wherein inclined chamfers are formed at both ends of the reinforcement part to smoothly insert the box part of the terminal into the accommodation chamber.

(3) The connector according to (1), wherein a pin-insertion port from which a conducting check pin of a checker fixture is to be inserted is formed in the housing at an opposite end to the insertion port, and the reinforcement part is formed within a range of a width of the pin-insertion port.

(4) The connector according to (1), wherein the reinforcement part is narrower in width than the lance, and is formed at an intermediate position of the lance in its width direction.

According to the connector as configured in (1), the band is integrally provided in the housing in the double end-supported state, and the lance is integrally provided in the band. Then, the terminal is locked by the lance. In this way, since the band is put into the double end-supported state, the lance can be held well in an appropriate engagement position. Further, since the band and the lance are integrally provided with the housing, it is possible to prevent increase of assembling labor time and to suppress assembling play which occurs between the lance and the terminal. In addition, the lance locks the concave part located between the box part and the core-wire crimped part of the terminal, and also the reinforcement part is formed in the housing to be protruded from the lance toward the bottom side of the concave part in order to reinforce the lance. Accordingly, it is possible to achieve downsizing in the height direction of the connector, and enhance the strength of terminal-engagement.

According to the connector as configured in (2), since the inclined chamfers are formed at both ends of the reinforcement part, the box part of the terminal can be smoothly inserted into the accommodation chamber.

According to the connector as configured in (3), since the reinforcement part is formed within a range of the width of the pin-insertion port in the housing, the reinforcement part can be formed by utilizing the range of the pin-insertion port.

According to the connector as configured in (4), since the reinforcement part is narrower in width than the lance, and is formed at an intermediate position of the lance in its width direction, a height of the reinforcement part can be secured without affecting an outer dimension of the connector

Advantageous Effects of Invention

According to the aspects of the present invention, there can be provided a connector capable of preventing increase in assembling labor time and deterioration of the connection reliability and capable of downsizing in the height direction and enhancing the strength of terminal-engagement.

The aspects of the present invention have been simply described. The detail of the present invention will be further definite if one reads an embodiment of the present invention as described below with reference to the accompanying drawings.

DESCRIPTION OF EMBODIMENTS

An example of an embodiment of the present invention will be described with reference to the drawings.

Figure 1:
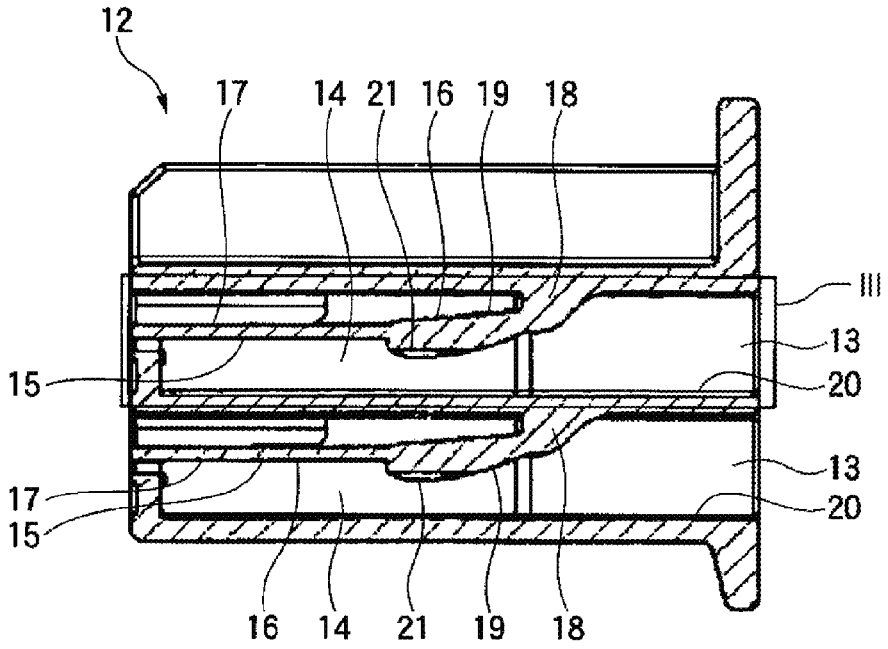
FIG. 1 is a cross-sectional view showing a housing of a connector according to an embodiment of the invention.
Figure 2:
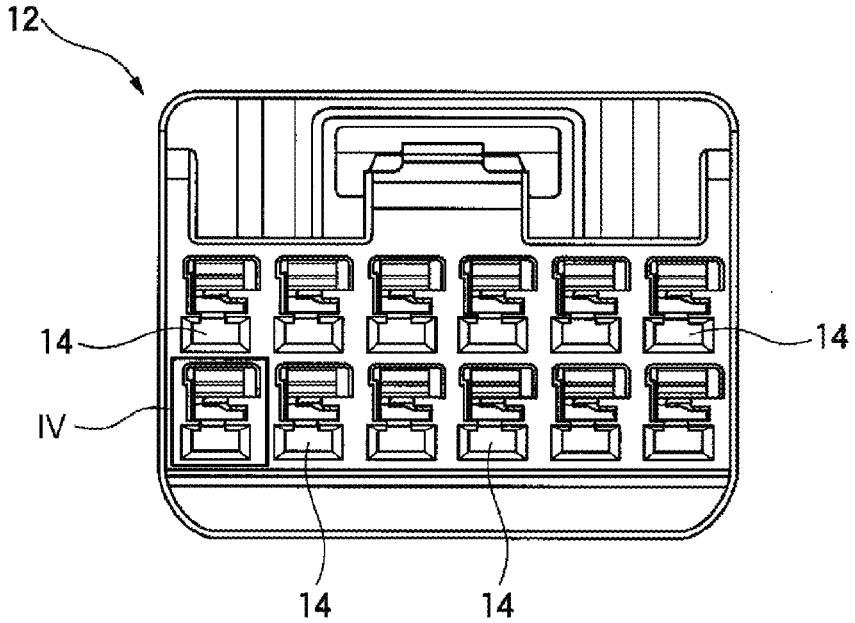
FIG. 2 is a front view showing the housing of the connector according to the embodiment of the invention.
Figure 3:
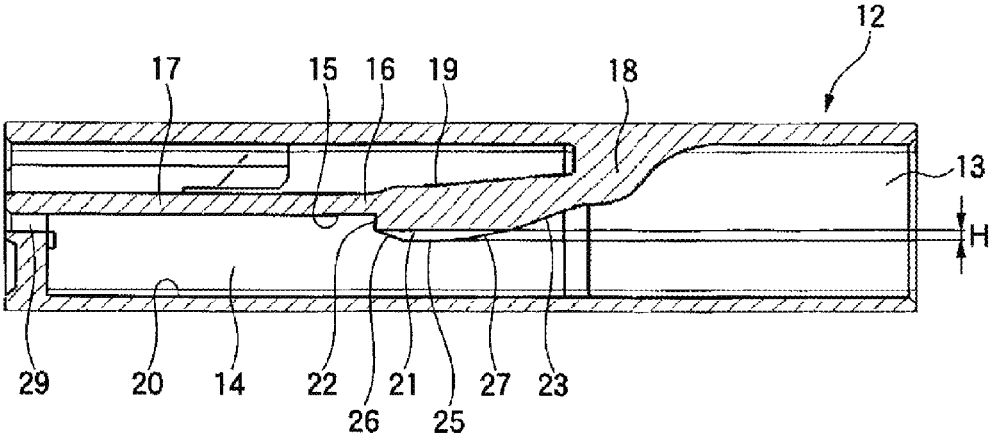
FIG. 3 is an enlarged view of part III in FIG. 1.
Figure 4:
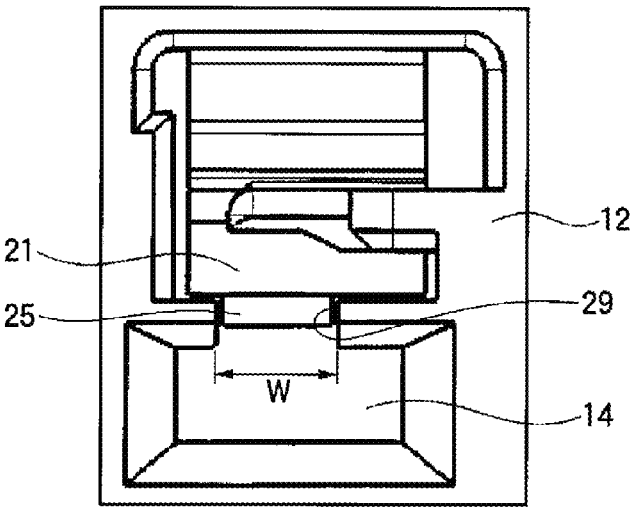
FIG. 4 is an enlarged view of part IV in FIG. 2.
Figure 5:
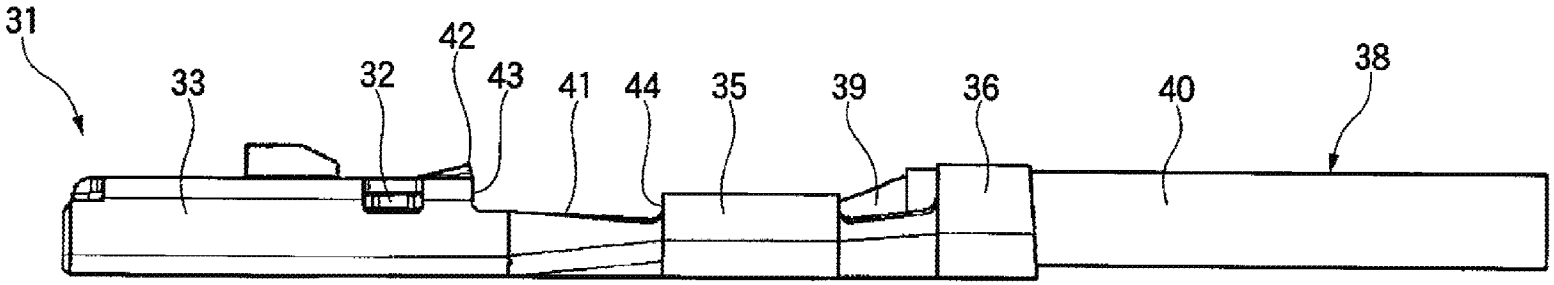
FIG. 5 is a side view showing a terminal of the connector according to the embodiment of the invention.
Figure 6:
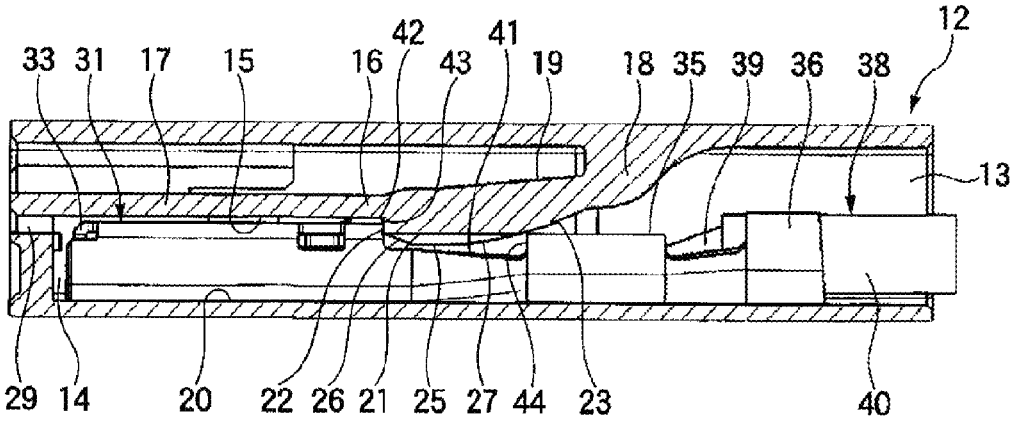
FIG. 6 is a cross-sectional view of partly enlarging the connector according to the embodiment of the invention.

FIG. 1 is a cross-sectional view showing a housing of a connector according to an embodiment of the invention. FIG. 2 is a front view showing the housing of the connector according to the embodiment. FIG. 3 is an enlarged view of part III in FIG. 1. FIG. 4 is an enlarged view of part IV in FIG. 2. FIG. 5 is a side view showing a terminal of the connector according to the embodiment. FIG. 6 is a cross-sectional view of partly enlarging the connector according to the embodiment.

As shown in FIG. 1 and FIG. 2, the connector according to the embodiment includes a housing 12 made of synthetic resin. The housing 12 includes accommodation chambers 14, each chamber having an insertion port 13 which opens outside the housing 12 formed at a rear end of the chamber. The accommodation chambers 14 are provided in multiple stages in a vertical direction and in multiple lines in a lateral direction.

As shown in FIG. 3, in the accommodation chamber 14, a part of an upper-side inner wall 15 is constituted by a band 16 which extends in a longitudinal direction. In the band 16, an intermediate portion 19 located between a connection plate portion 17 at a front end and a connection portion 18 at a rear end is not supported except the connection plate portion 17 and the connection portion 18. That is, the intermediate portion 19 becomes in a floating state assuming that the connection of the intermediate portion 19 to the connection plate portion 17 and the connection portion 18 is lost. In conclusion, the band 16 is in a double end-supported state while the connection plate portion 17 and the connection portion 18 at both front and rear ends serve as fulcrum. A lance 21 is formed at the intermediate portion 19 of the band 16 and protruded towards a lower-side inner wall 20. An engaging surface 22 is formed at a front end of the lance 21 and perpendicular to a longitudinal direction of the accommodation chamber 14. A chamfer 23 is formed at a rear end of the lance 21 in a rear-up state.

In the housing 12, a reinforcement part 25 is formed to be protruded from a lower surface (ventral surface) of the lance 21 toward the lower-side inner wall 20. The reinforcement part 25 is continuous from a lower end of the engaging surface 22 of the lance 21 and formed at a rear side of the engaging surface 22. Whole part of the reinforcement part 25 is located on the lower side of the engaging surface 22. A chamfer 26 is formed at a front end of the reinforcement part 25, and a chamfer 27 is formed at a rear end of the reinforcement part 25. The chamfer 26 at the front end is inclined in a front-up state, and the chamfer 27 at the rear end is inclined in a rear-up state and linked to the chamfer 23. The accommodation chambers 14, the bands 16, the lances 21 and the reinforcement parts 25 are formed at the time of integrally forming the housing 12.

In the housing 12, a pin-insertion port 29 from which a conducting check pin of a checker fixture is inserted is formed at a lower side of the front end of the connection plate portion 17 of the band 16 so that the accommodation chamber 14 opens toward the outside. In other words, the pin-insertion port 29 is formed at an opposite side to the insertion port 13 of the accommodation chamber 14. The conducting check pin of the checker fixture not shown in figures is inserted to the pin-insertion port 29 from the front side.

As shown in FIG. 4, the pin-insertion port 29 is narrower in width than the accommodation chamber 14 in a lateral direction, and is formed at an intermediate position of the accommodation chamber 14 in the lateral direction. The reinforcement part 25 is formed within a range of a width W of the pin-insertion port 29. Thus, the reinforcement part 25 is narrower in width than the lance 21, and is formed at an intermediate position of the lance 21 in its width direction.

As shown in FIG. 5, a terminal 31 is a female terminal in which a box part 33 which covers a terminal-contact spring 32 is formed at a front end. That is, a tab of a male terminal not shown in figures is inserted in the box part 33 of the terminal 31. The tab of the male terminal 31 contacts the terminal-contact spring 32, thereby obtaining electric conduction between the male terminal and the female terminal.

In the terminal 31, a core-wire crimped part 35 is formed at an intermediate part, and a sheath crimped part 36 is formed at a rear end. The core-wire crimped part 35 is crimped to hold a core wire 39 of an electric wire 38 therein. The sheath crimped part 36 is crimped to hold a outer sheath 40 of the electric wire 38 therein. The terminal 31 is formed by punching and folding a metallic plate. A concave part 41 is formed between the box part 33 and the core-wire crimped part 35 so that the concave part 41 is dented below upper ends of the box part 33 and the core-wire crimped part 35. An engaging protruded piece 42 is cut and raised to be protruded from a rear end of the box part 33 upwardly. The engaging protruded piece 42 is deformable downwardly.

As shown in FIG. 6, the terminal 31 is accommodated in the accommodation chamber 14 of the housing 12. In this case, the terminal 31 is inserted from the insertion port 13 to the accommodation chamber 14 with the box part 33 in the lead of insertion. At this time, a front end of the box part 33 contacts the chamfer 23 of the lance 21 to press up the lance 21, thereby elastically deforming the band 16. Subsequently, the front end of the box part 33 contacts the chamfer 27 of the reinforcement part 25 to press up the reinforcement part 25, thereby elastically deforming the band 16. When the box part 33 runs over the lance 21, the press-up force by the box part 33 is released and the band 16 is restored. In this way, the lance 21 and the reinforcement part 25 enter in the concave part 41 of the terminal 31. As a result, the connector is put into an engagement state in which the engaging surface 22 of the lance 21 engages an engaged surface 43 of the concave part 41 of the terminal at a side of the box part 33.

That is, in the engagement state, the engaging surface 22 of the lance 21 contacts the engaged surface 43 of the concave part in the longitudinal direction by aligning the positions side to side and up and down. In the engagement state, the engaging protruded piece 42 of the box part 33 is elastically deformed and forces the box part 33 to be pressed on the lower-side inner wall 20 of the accommodation chamber 14. In the engagement state, the reinforcement part 25 of the housing 12 is protruded from the lance 21 further toward the bottom side of the concave part 41 to reinforce the lance 21. In addition, in the engagement state, the reinforcement part 25 aligns the position of an opposed surface 44 opposite to the engaged surface 43 of the concave part 41 side to side and up and down As described above, according to the connector in the embodiment, the band 16 is integrally provided in the housing 12 in the double end-supported state, and the lance 21 is integrally provided in the band 16. Then, the terminal 31 is locked by the lance 21. In this way, since the band 16 is put into the double end-supported state, its rigidity increases, and the lance 21 can be held at an appropriate engagement position. That is, the lance 21 can be held at the appropriate engagement position even if a strong pull force of the electric wire 38 is transferred to the lance 21 through the terminal 31.

Further, since the band 16 and the lance 21 are integrally provided with the housing 12, it is possible to prevent increase of assembling labor time and to suppress assembling play which occurs between the lance 21 and the terminal 31.

In addition, the lance 21 locks the concave part 41 located between the box part 33 and the core-wire crimped part 35 of the terminal 31, and also the reinforcement part 25 is formed in the housing 12 to be protruded from the lance 21 toward the bottom side of the concave part 41 in order to reinforce the lance 21. Accordingly, it is possible to achieve downsizing in the height direction of the connector, and enhance the strength of terminal-engagement. That is, since the concave part 41 is formed between the box part 33 and the core-wire crimped part 35 of the terminal 31, the dent depth of the concave part 41 can be large. Accordingly, it is possible to form the reinforcement part 25 for reinforcing the strength of terminal-engagement of the lance 21 while securing the engaging part of the lance 21 by utilizing the concave part 41. In this way, a height H of the reinforcement part shown in FIG. 3 can be secured without affecting an outer dimension of the connector. As a result of forming the reinforcement part 25, it is possible to prevent the vicinity of the lance 21 from being damaged even if the strong pull force of the electric wire 38 is transferred to the lance 21 through the terminal 31, thereby locking the terminal 31 surely without double engagement.

As described above, it is possible to prevent increase in assembling labor time and deterioration of the connection reliability and to achieve downsizing in the height direction and enhancing the strength of terminal-engagement.

Further, the reinforcement part 25 is formed within a range of the width W of the pin-insertion port 29 in the housing 12. Thus, the reinforcement part 25 can be formed by utilizing the range of the pin-insertion port 29.

The present invention is not limited to the above-described embodiment, and deformation and modifications can be arbitrarily made. Further, materials, shapes, dimensions, numbers, arrangement location and the like of the constituent elements in the embodiment can be set arbitrarily within the range in which the invention is achieved, and no limitation is placed thereon.

This application is based on and claims the benefit of Japanese patent application (No. 2010-285092) filed on Dec. 21, 2010, the contents of which are incorporated herein by reference.

The invention claimed is:

1. A connector, comprising:

a terminal including a box part which covers a terminal-contact spring, a crimped part which holds a core wire, a concave part which is formed between the box part and the crimped part, and an engaging surface; and a housing integrally including:

an insertion port from which the terminal is inserted, an accommodation chamber in which the terminal is accommodated, a band which constitutes a part of the accommodation chamber and includes a first connection portion extended from a first position of the housing at a first end of the band, a second connection portion extended from a second position of the housing at a second end of the band, and an intermediate portion which continuously joins the first and second connection portions, thereby putting into a double end-supported state so that the intermediate portion of the band is pressed and elastically deformed by the box part of the terminal when the terminal is inserted in the housing from the insertion port, a lance which protrudes from the intermediate portion of the band and includes an engaging surface engaged by the engaging surface of the terminal to lock the concave part of the terminal, and a reinforcement part which protrudes from the lance toward a bottom side of the housing to enter in the concave part of the terminal, and includes a surface that extends from the engagement surface of the lance at an angle, wherein a pin-insertion port from which a conducting check pin of a checker fixture is to be inserted is formed in the housing at an opposite end to the insertion port, and the reinforcement part is formed within a range of a width of the pin-insertion port, the reinforcement part is narrower in width than the lance, and is formed at an intermediate position of the lance in the lance's width direction, and the width of the reinforcement and the width of the lance are measured in a direction that is substantially perpendicular to the insertion direction of the terminal.

2. The connector according to claim 1, wherein inclined chamfers are formed at both ends of the reinforcement part to smoothly insert the box part of the terminal into the accommodation chamber.

3. The connector according to claim 1, wherein the first connection portion and the second connection portion are respectively extended from the first position and the second position of a common wall of the housing.

4. The connector according to claim 1, wherein the first connection portion extends from the first position located on a first wall of the housing, and the second connection portion extends from the second position located on a second wall of the housing, the second wall being offset from the first wall of the housing.

* * * * *